US006270656B1

(12) United States Patent
Gibson et al.

(10) Patent No.: US 6,270,656 B1
(45) Date of Patent: Aug. 7, 2001

(54) REDUCTION OF COKER FURNACE TUBE FOULING IN A DELAYED COKING PROCESS

(75) Inventors: William C. Gibson, Tulsa; Robert L. Gibson, Broken Arrow, both of OK (US)

(73) Assignee: Petro-Chem Development Co., Inc., New York, NY (US)

( * ) Notice: Subject to any disclaimer, the term of this patent is extended or adjusted under 35 U.S.C. 154(b) by 0 days.

(21) Appl. No.: 09/370,165

(22) Filed: Aug. 9, 1999

(51) Int. Cl.[7] ..... C10G 9/16

(52) U.S. Cl. ..... 208/131; 208/48 R; 208/48 AA; 208/50

(58) Field of Search ..... 208/131, 132, 208/50, 48 R, 48 AA; 201/28, 29, 30

(56) References Cited

U.S. PATENT DOCUMENTS 3,878,088 * 4/1975 Nahas et al. ..... 208/50
4,455,219 * 6/1984 Janssen et al. ..... 208/131
4,518,487 * 5/1985 Graf et al. ..... 208/131
4,549,934 * 10/1985 Graf et al. ..... 196/98
4,661,241 * 4/1987 Dabkowski et al. ..... 208/131
4,720,338 * 1/1988 Newman et al. ..... 208/131
4,797,197 * 1/1989 Mallari ..... 208/131
5,645,712 * 7/1997 Roth ..... 208/131
5,824,194 * 10/1998 Kruse ..... 201/29

* cited by examiner

*Primary Examiner*—Bekir L. Yildirim
(74) *Attorney, Agent, or Firm*—Breiner & Breiner

(57) ABSTRACT

In a delayed coking process, furnace tube fouling is minimized by including a measured amount of full boiling range heavy gas oil as an additive in the furnace feed, preferably by forced recycle from a heavy gas oil stream. An additive is preferably supplied directly to individual furnace tubes by multiple circumferential injection upstream of each tube receiving the additive.

3 Claims, 2 Drawing Sheets

10
24
28
34
36
11
16
26
26
25
38
18
20
22
V
30
24
32

40
66
76
74
78
52
72
72
58
60
42
62
46
48
64
V
44
70
50

80
66
76
74
78
52
72
72
58
60
62
64
V
70
82
90
86
84
90
44

5
FLOW
96
92
94
5

92
96
94

REDUCTION OF COKER FURNACE TUBE FOULING IN A DELAYED COKING PROCESS

FIELD OF THE INVENTION

The present invention relates to delayed coking operations. More particularly, the present invention relates to a process and apparatus for reducing coker furnace tube fouling by adding full boiling range heavy gas oil to the coker furnace feed.

BACKGROUND OF THE INVENTION

Delayed coking operations involve thermal cracking of heavy liquid hydrocarbons to produce various more valuable hydrocarbon fractions and coke. Any suitable delayed coking feedstock can be used as starting material, including liquid vacuum resid from a crude oil refining process.

Delayed coking is generally carried out by initially heating a liquid feedstock in a coking furnace to a coking temperature, often between 875° F. and 950° F. The furnace includes a coil of multiple furnace tubes wherein the feedstock is heated before passing to a coker drum. The furnace tubes of an operating furnace include temperature and pressure gradients along the coil. Thermal cracking of the heated feedstock occurs primarily in the coking drum to yield mixed volatile hydrocarbon vapors and coke. The vapors are drawn off overhead and introduced to a fractionator column wherein hydrocarbon fractions including gases, gasoline, one or more distillate streams and a heavy gas oil stream are separated and subsequently isolated.

There are several operating requirements and objectives that are normally considered in developing and optimizing a delayed coking process. It has often been sought to efficiently minimize the overall coke yield while also minimizing fouling of the radiant coker furnace tubes by premature coking. Fouling of the internal walls of the furnace tubes can cause blockages requiring periodic operation shut-downs to clear the lines. Modern delayed coking operations present the potential for rapid tube fouling due to increased feed rates and increased concentrations of fouling components in feedstocks such as asphaltenes, inorganics and heavy metals.

It has been found that a useful coker furnace operation preferably includes blending with the feedstock a natural heavy recycle material fed from the fractionator bottom. The recycle improves the operation of the furnace and provides a solvent effect to the feed that aids in reducing fouling (coking) on the walls of the furnace tubes. Depending on the particular coking system, the recycle material has a boiling range from as low as 400° F. to over 1000° F. However, a competing consideration is that the recycle material can potentially increase the overall coke yield in the coke drum at the expense of other more desirable hydrocarbon products.

The fractionator column for flash distillation in a delayed coking unit is typically equipped with a spray down source of heavy gas oil for condensing hydrocarbon vapors entering the fractionator from the coker drum. Heavy gas oil can also be used to quench vapors leaving the coke drum. The spray down and quench can be fed directly from a heavy gas oil collection tray on the column and comprise at least part of the natural heavy recycle to be combined with the feedstock.

Improvements in coker fractionators have led to reductions in the quantity of heavy spray down material required for proper fractionator operation. Modern feedstock compositions also frequently inherently require less quench and spray-down because less gas product is produced. In response, a supplemental hydrocarbon diluent fed to the furnace in addition to the natural heavy recycle has been proposed, such as in the case of coking a resid from a low gravity crude. The diluent can be provided as forced recycle diverted directly from a fractionator product stream. Due to the increased potential for coke formation, however, prior art methods have sought to avoid higher boiling diluents or additives, such as heavy gas oil, and have sought to reduce the recycle rate.

With an objective of reducing overall coke yield, U.S. Pat. No. 4,455,219 discloses a method of minimizing heavy recycle in a delayed coking operation and blending the coker furnace feed with a forced recycle of a lower boiling distillate stream taken from an intermediate fractionator tray, most preferably with a boiling range of from about 510° F. to 650° F.

Similarly, in providing a diluent material to aid furnace operation, U.S. Pat. No. 4,518,487 discloses a process for reducing coke yields by eliminating the natural heavy recycle and substituting an intermediate distillate as a recycle component. It is said that elimination of the heavier components of the furnace feed is especially important. Therefore, a forced recycle component having a boiling range upper end below 850° F. is said to be required.

U.S. Pat. No. 4,549,934 discloses a process for removing condensed coke drum vapors from a fractionator to completely prevent their appearance as recycle in the furnace feed. A recycle material lighter than heavy gas oil is substituted into the furnace feed.

U.S. Pat. No. 5,645,712 discloses a process having a purpose of reducing coke yield wherein light gas oil from a coker fractionator is separately heated and directly introduced to a coking drum.

Prior art processes have been primarily concerned with reducing overall coke yields by minimizing heavy recycle rates and substituting distillates such as light gas oil for all or a portion of the natural heavy recycle. Unfortunately, the prior art has not recognized that light distillates do not provide optimal results in a delayed coking operation, especially in terms of furnace operation efficiency. Modern delayed coking operations now often work at higher feed rates with feedstocks containing higher concentrations of carbon residue and other fouling components. Therefore, the prior art methods of supplementing a coker feed with a distillate stream are often insufficient.

It would therefore be desirable to have an improved delayed coking apparatus and process without the shortcomings of the prior art. The present invention provides a delayed coking process and apparatus including superior reduction in furnace tube fouling rates without appreciable increases in coke yields as compared to prior art processes. This involves supplementing the natural heavy recycle with full boiling range heavy gas oil, such as that taken directly from a coker fractionator heavy gas oil stream. The invention further provides a method and apparatus for injecting a coker feed additive in order to maximize its anti-fouling effectiveness. Other aspects of the invention will be apparent from the following summary and detailed description of the invention.

OBJECTS AND SUMMARY OF THE INVENTION

A primary object of the present invention is to provide a delayed coking process and apparatus with reduced furnace tube fouling rates.

Another primary object of the invention is to provide a delayed coking process and apparatus with increased coking operation run time between furnace decoking or clearing procedures.

A further primary object of the invention is to provide a delayed coking process and apparatus utilizing full boiling range heavy gas oil as a portion of the coker furnace feed.

A further object of the invention is to provide a delayed coking process and apparatus utilizing forced recycle of full boiling range heavy gas oil from a fractionator heavy gas oil stream to a coker furnace as a portion of the coker furnace feed.

A further object of the present invention is to provide a process and apparatus for injecting a coker feed additive or diluent material into a coker feed stream to maximize its anti-fouling effectiveness.

A further object of the present invention is to provide a process and apparatus for direct circumferential injection of a hydrocarbon additive to the heater tubes of a coker furnace.

It has been found that when running with today's lower recycle rates, the lower boiling components of the natural heavy recycle are often substantially flashed back up the column to the heavy gas oil tray and do not make up a significant part of the natural recycle. Stated otherwise, the natural recycle material can have a disproportionately high concentration of its heaviest components. Recognizing this, we have found that blending a coker feed with full boiling range heavy gas oil (HGO), such as that typically drawn from a coker fractionator's heavy gas oil stream, provides a heavy coker additive that includes the components of natural heavy recycle but with substantial concentrations of material throughout its entire boiling range. Therefore, an important part of the present invention is the discovery that full boiling range heavy gas oil, typically having a boiling range of between about 500° F. to about 1000° F., depending on its source, provides optimum furnace tube fouling reduction. Of course, due to the nature of hydrocarbon separations, minor amounts of materials boiling outside these ranges can also be present.

In one aspect of the invention, an additive especially capable of removing or "shredding" a hydrocarbon film from coker furnace tube walls throughout the entire length of the furnace coil in order to prevent overheating and resultant fouling is provided.

The present invention provides a delayed coking process and apparatus wherein a measured amount of full boiling range heavy gas oil (HGO) is included in the coker furnace feed. The HGO can be supplied from any source, most conveniently as forced recycle of material from a fractionator HGO tray located above the coke drum vapor inlet and the spray down nozzles.

In another aspect of the invention, a coker feed includes a hydrocarbon additive injected into the feed at one or more of several locations upstream of the coker furnace and/or at the individual coker furnace tubes. Preferably, the additive includes HGO and is injected at multiple locations including in the return bends of the furnace coil upstream of the individual coker furnace tubes.

In another aspect of the invention, to maximize its effectiveness, a hydrocarbon additive is injected into a coker feed using circumferential injection at a location in the return bend immediately upstream of each furnace tube receiving the additive.

BRIEF DESCRIPTION OF THE DRAWING

The foregoing summary, as well as the following detailed description of the presently preferred embodiments of the invention, will be better understood when read in conjunction with the appended drawings. For purposes of illustrating the invention, there is shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
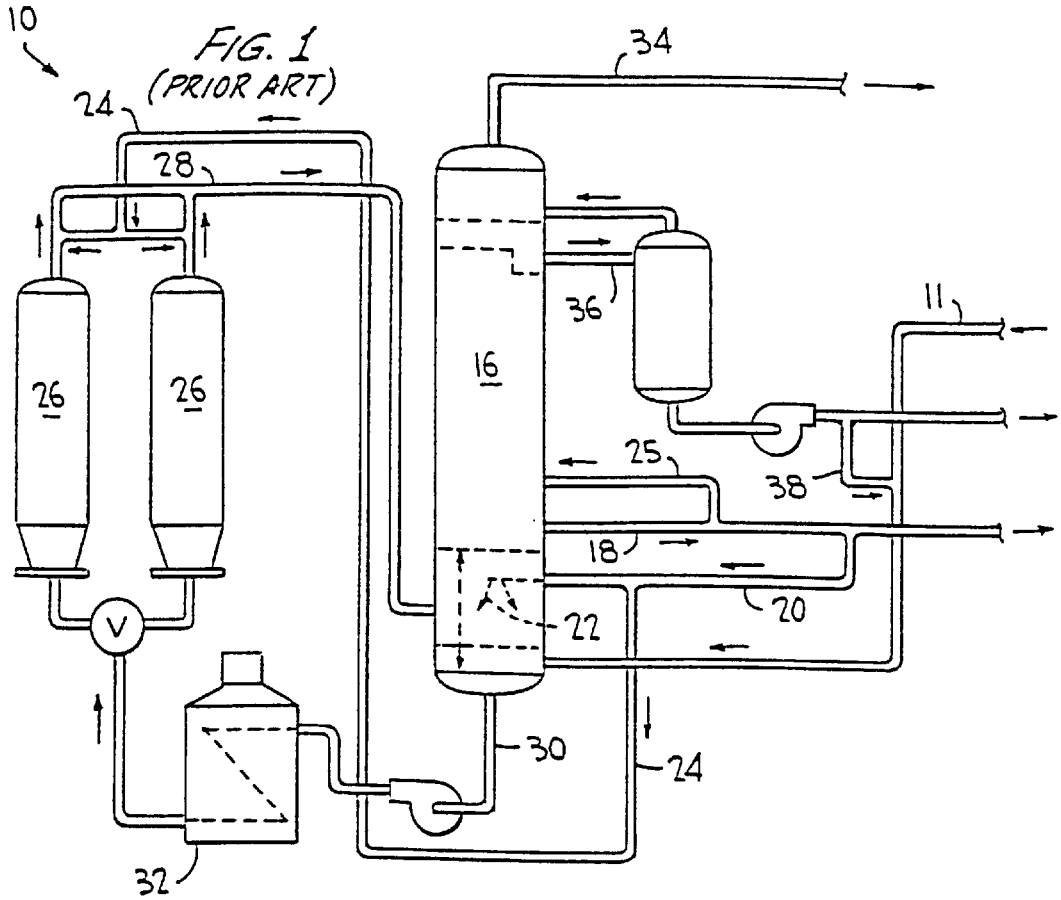
FIG. 1 (PRIOR ART)
FIG. 1 is a schematic flow diagram illustrating a prior art delayed coking process.

FIG. 1 shows a prior art delayed coking unit 10 such as disclosed in U.S. Pat. No. 4,455,219 including recycle of light gas oil (LGO) from the coker fractionator to the coker feed. Fresh coker feed from line 11 can be preheated by heat exchangers (not shown) and fed to the bottom of coker fractionator 16. Full boiling range heavy gas oil (HGO) is withdrawn from the HGO tray via line 18 and partially diverted via line 20 to spray down nozzles 22 and via line 24 to quench vapor from coke drums 26. HGO can also be introduced through line 25 as internal reflux. Coke drum vapors from line 28 enter the flash zone of fractionator 16 where the heaviest components thereof are condensed by contact with HGO from spray nozzles 22. These and the spray-down material combine with fresh feed from line 11 in the bottom of the flash zone.

The combined feed is passed via line 30 to coker furnace 32 where it is heated to coking temperature and passed into one of coking drums 26. Coking produces volatile products removed via line 28 and coke which accumulates in the drum. Fractionator 16 separates light gases overhead at line 34, LGO distillate at line 36 and HGO at line 18. The feed 11 can be supplemented with forced recycle of LGO from line 36 as a diluent via line 38.

As previously mentioned, modern coking operations often require inclusion of a hydrocarbon additive in the coker feed because natural recycle quantities are insufficient for proper furnace operation. It has further been found that often little full boiling range heavy gas oil (HGO) naturally reaches the bottom of the fractionator because the lower boiling components such as those boiling under 820° F. are substantially flashed back up the fractionator column to the heavy gas oil tray. Thus, the natural heavy recycle can be disproportionately lacking in the lighter components of HGO.

The prior art discloses that optimum delayed coking is achieved when a light gas oil distillate is provided as a diluent. Higher boiling diluent were avoided because they were thought to detrimentally increase overall coke yield as a result of coking of the higher boiling components. To the contrary, it has now been found that optimal operation of a coker furnace includes the addition of an effective amount of HGO to the coker feed. This is thought to be due to its particular composition which includes substantial concentrations of hydrocarbons boiling up to 1000° F. and as low as 500° F. As described in greater detail below, the HGO boiling range provides a spectrum of materials capable of shredding a fluid film throughout the pressure and temperature gradients of a coker furnace. While prior art distillate additives may serve as diluents which rapidly vaporize and increase linear velocity, the HGO of the present invention is superior for preventing furnace tube fouling in today's heavy feedstocks to a degree that outweighs its effect on overall coke yield when used according to the present invention.

Figure 2:
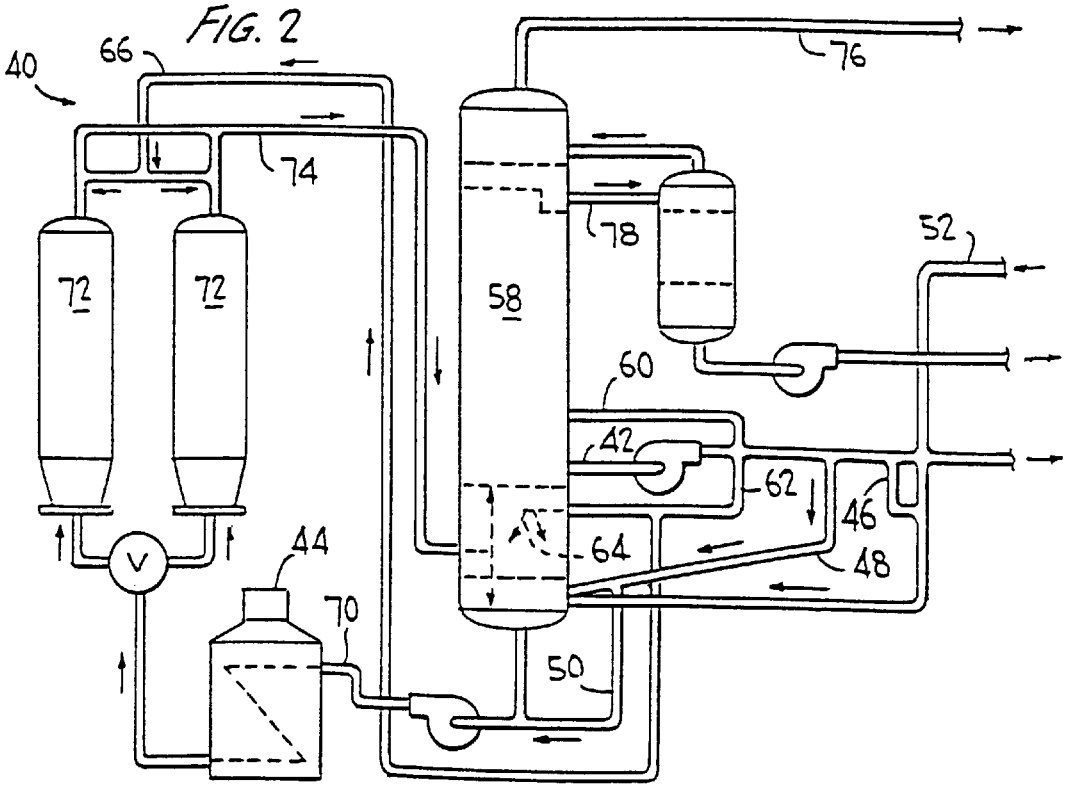
FIG. 2 is a schematic flow diagram illustrating a delayed coking process and apparatus according to the present invention.

FIG. 2 shows delayed coking unit 40 illustrating a delayed coking process according to the present invention. An important aspect of the present invention is the inclusion of an amount of full boiling range heavy gas oil (HGO) as an additive in the coker feed. In the embodiment shown, HGO is supplied directly as forced recycle from the HGO tray (not shown) above the spray down nozzles 64 via line 42. HGO can be injected at any one or more locations upstream of coker furnace 44. By way of example, HGO can be injected via any one or more of lines 46, 48 and 50. Preferably, HGO is introduced downstream of fractionator 58.

The composition of HGO is defined as the mixture typically isolated at the HGO tray of a coker fractionator. In a typical coking operation, and depending on the fractionator operating pressure and tray temperature, HGO boils between approximately 500° F. and 1000° F., often with over 70% by weight of the HGO material boiling above 700° F. and 20% boiling above 900° F. The actual boiling range depends on the source of the material including, in the case of a recycled HGO, the temperature and pressure characteristics of the source fractionator. Its A.P.I. gravity is generally below 25 and its pseudo critical temperature is often between 950° F. and 1150° F. The HGO additive used according to the present invention preferably has similar characteristics.

The process and apparatus thus described greatly reduce coker furnace tube fouling without significantly increasing overall coke yield. The result is valuable increases in run time before shutdown and clearing of the furnace tubes. Not being bound by theory, the HGO is superior to LGO and other additives for reducing furnace tube fouling rates because it is effective throughout the entire furnace. Most fouling normally occurs in the higher temperature, lower pressure areas of the furnace closer to the outlet. In these areas, the fluid film on the furnace tube walls is less able to transfer heat to the bulk fluid. LGO has generally already been vaporized in this region and therefore has no continuing shredding effect. This is unavoidable due to the relatively low critical temperature of LGO. By contrast, HGO vaporizes progressively throughout the furnace pressure profile and exhibits a significant increase in volume during vaporization because boiling of HGO occurs well below its critical temperature. This volume increase explodes or shreds the fluid film back into the bulk fluid in the furnace tubes.

The amount of HGO included in the coker feed according to the present invention is that which is required for efficient furnace operation and fouling inhibition and is dependent on the quality of the coker feedstock in terms of its gravity and composition. For example, feedstocks having relatively high carbon residue and asphaltene content will require larger quantities of HGO to effectively shred the fluid film from the furnace tubes walls and back into the bulk fluid. The amount is also dependent on the rate of HGO of natural heavy recycle. While not limiting to the invention, a rate of from about 3% to 30% relative to the feedstock is effective.

As described above, the operation of coker unit 40 includes the addition of HGO to the furnace feed. Fresh coker feed delivered via line 52 can be preheated by heat exchangers (not shown). HGO is drawn off via line 42. Portions of the material from line 42 can be recycled as ref lux via line 60, diverted via line 62 to spray-down nozzles 64 and diverted via line 66 to quench coker drum vapors. Further, an amount of HGO from line 42 is diverted to one or more of lines 46, 48 and 50 as forced recycle material to coker furnace 44.

The combined coker feed passes through line 70 to coker furnace 44 where it is heated to coking temperature and passed to one of coking drums 72 maintained at appropriate coking conditions. Thermal cracking produces coke and volatile hydrocarbon vapors drawn off via line 74 to fractionator 58. Quench material from line 66 can he used to condense the heavier of the coker drum vapors. Lighter materials are flashed up fractionator 58 where various fractions including gases, LGO and an HGO stream are isolated at lines 76, 78 and 42, respectively.

Figures 3, 4, 5:
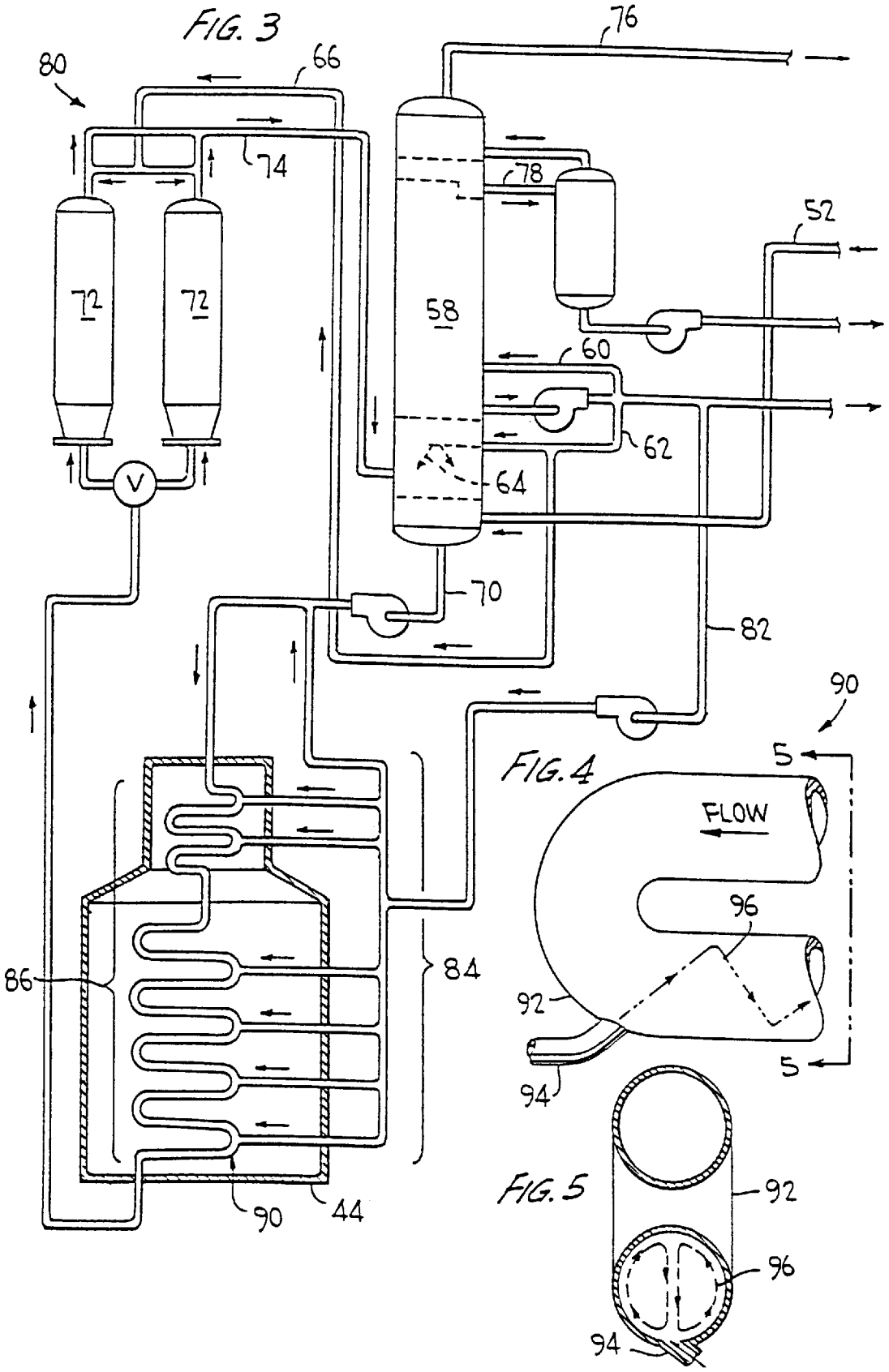
FIG. 3 is a schematic flow diagram illustrating multiple forced recycle of HGO according to the present invention.
FIG. 4 is a side view of a section of coker furnace tubing illustrating a coking process and apparatus according to the present invention.
FIG. 5 is the tubing of FIG. 4 viewed along line 5—5.

In another embodiment of the present invention, full boiling range heavy gas oil (HGO) is directly injected at multiple locations upstream of individual furnace tubes. Referring to FIG. 3, in which like numbers are used for those items which are common to FIG. 2, delayed coker unit 80 is shown wherein the desired amount of HGO is supplied to the furnace heating tubes from heavy gas oil line 42 as a forced recycle. In this embodiment, an additive is supplied directly to coker furnace 44 by line 82 and preferably by multiple branch lines 84 providing forced injections of HGO in the return bends of the furnace tubes, each injection slightly upstream of the radiant section of each tube 86. Preferably, an injection line is provided at each furnace heater tube, however the benefits of the invention are achieved by fewer injection locations.

The use of direct injection is preferred because it further assures that adequate HGO is provided at all of the locations where tube fouling can occur. Direct injection of HGO also requires a smaller overall amount of forced recycle than upstream injection does to provide the same level of beneficial anti-fouling effect. Therefore, inclusion of multiple direct injection in the process of the present invention is normally preferred. The added benefit of direct injection is cumulative to the advantages of HGO over LGO, mentioned previously. The process as illustrated in FIG. 3 can be modified to also include upstream HGO injections as described previously with reference to FIG. 2.

As illustrated in FIGS. 4 and 5, a hydrocarbon additive is preferably injected to the coker furnace tubes in a circumferential pattern to create a cork-screw flow pattern down the length and along the walls of each receiving tube. In FIGS. 4 and 5, section 90 of coker furnace coil 86 (shown in FIG. 3) is shown for purposes of illustration. Circumferential injection of additive from branch 94, preferably including HGO, maximizes the reduction of tube fouling associated with overheating the fluid film on the walls of the radiant heater tubes. By injecting at an angle to the tube wall in the downstream end of bend 92, as shown in FIG. 5, advantage is taken of the inherent secondary flow characteristics caused by the bend. Centrifugal force maintains a larger concentration of the additive at the furnace wall. This flow carries the additive along corkscrew pattern 96 such that it shreds the film on the tube walls dislodging it back into the bulk flow. Due to increased efficiency, circumferential injection of the additive requires less additive for effective fouling inhibition as compared to other methods.

As will be apparent to one skilled in the art, various modifications can be made within the scope of the aforesaid description. Such modifications being within the ability of one skilled in the art form a part of the present invention and are embraced by the appended claims.

What is claimed is:

1. A delayed coking process comprising the steps of:

supplying a feedstock including a natural recycle material to a coker furnace having one or more heating tubes;

heating said feedstock in said furnace to a coking temperature;

passing said feedstock to a coke drum to coke said feedstock;

removing vapors formed in said coke drum;

passing said vapors to a fractionator;

condensing a portion of said vapors with a hydrocarbon spray to form at least a portion of said natural recycle;

combining said natural recycle with said feedstock;

adding in a circumferential pattern an amount of full boiling range heavy gas oil to said feedstock in at least one location at said furnace; and said amount being effective to minimize furnace tube fouling.

2. The process of claim 1, wherein said full boiling range heavy gas oil is injected circumferentially near the downstream end of the return bend of at least one of said heating tubes.

3. A delayed coking process comprising the steps of:

supplying a feedstock including a natural recycle material to a coker furnace having one or more heating tubes;

heating said feedstock in said furnace to a coking temperature;

passing said feedstock to a coke drum to coke said feedstock;

removing vapors formed in said coke drum;

passing said vapors to a fractionator;

condensing a portion of said vapors with a hydrocarbon spray to form at least a portion of said natural recycle;

combining said natural recycle with said feedstock;

adding in a circumferential pattern to said feedstock an amount of a hydrocarbon additive near the downstream end of the return bend of at least one of said heating tubes; and said amount being effective to minimize furnace tube fouling.

* * * * *